US012733761B2

(12) United States Patent
Santana

(10) Patent No.: US 12,733,761 B2
(45) Date of Patent: Sep. 15, 2026

(54) COMBINATION BEVERAGE CONTAINER AND BOWL

(71) Applicant: James Santana, Lawndale, CA (US)

(72) Inventor: James Santana, Lawndale, CA (US)

( * ) Notice: Subject to any disclaimer, the term of this patent is extended or adjusted under 35 U.S.C. 154(b) by 0 days.

(21) Appl. No.: 18/949,601

(22) Filed: Nov. 15, 2024

(65) Prior Publication Data

US 2025/0160552 A1 May 22, 2025

Related U.S. Application Data

(60) Provisional application No. 63/601,123, filed on Nov. 20, 2023.

(51) Int. Cl.

| | |
|---|---|
| ***A47G 19/23*** | (2006.01) |
| ***A47G 19/08*** | (2006.01) |
| ***A47G 19/22*** | (2006.01) |

(52) U.S. Cl.

CPC ..... *A47G 19/23* (2013.01); *A47G 19/08* (2013.01); *A47G 19/2272* (2013.01)

(58) Field of Classification Search

CPC .... A47G 19/23; B65D 21/0209; B65D 25/16; B65D 25/18

USPC ..... 220/521

See application file for complete search history.

(56) References Cited

U.S. PATENT DOCUMENTS

| | | | | |
|---|---|---|---|---|
| 5,180,079 | A * | 1/1993 | Jeng | A47G 19/065 220/709 |
| 6,338,417 | B1 * | 1/2002 | Ferraro | A47G 19/06 206/217 |
| 2008/0053949 | A1 * | 3/2008 | Farrar | B65D 41/086 215/332 |
| 2023/0114442 | A1 * | 4/2023 | Benarde | A45C 3/00 220/713 |

* cited by examiner

*Primary Examiner* — Stephen J Castellano

(74) *Attorney, Agent, or Firm* — The Iwashko Law Firm, PLLC; Lev Ivan Gabriel Iwashko

(57) ABSTRACT

A combination beverage container and bowl, including a beverage container to receive a beverage threreinside, a lid to connect to a top portion of the beverage container, the lid including a rim disposed on an outer circumference of the lid, and a lid straw receiving aperture to receive a straw therethrough such that a user may drink the beverage stored in the beverage container through the straw, and a bowl to having a bottom portion thereof connected to a top portion the lid to receive food thereinside, the bowl including a bowl straw receiving aperture to correspond to the lid straw receiving aperture to allow the straw to be inserted simultaneously through the bowl straw receiving aperture and the lid straw receiving aperture.

3 Claims, 2 Drawing Sheets

COMBINATION BEVERAGE CONTAINER AND BOWL

CROSS-REFERENCE TO RELATED APPLICATIONS

This application claims priority under 35 USC § 120 from U.S. Provisional Application No. 63/601,123, entitled "COMBINATION BEVERAGE CONTAINER AND BOWL," which was filed on Nov. 20, 2023, in the United States Patent and Trademark Office, the disclosure of which is incorporated herein in its entirety by reference.

BACKGROUND

1. Field

The present general inventive concept relates generally to a beverage container and bowl, and particularly, to a combination beverage container and bowl.

2. Description of the Related Art

Popcorn and beverages (i.e., soda, soft drinks, pop, punch, lemonade, etc.) are often enjoyed together while watching TV at home, at a movie theater, or at outdoor events. Traditional popcorn containers, however, tend to require consumers to carry separate cups for their beverages, and often necessitate multiple trips to the concession stand to gather all preferred snacks, especially when someone wants to carry multiple beverages and/or containers of popcorn.

Therefore, there is a need for a container that allows a user to carry both popcorn and a beverage in one hand.

SUMMARY

The present general inventive concept provides a combination beverage container and bowl.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a combination beverage container and bowl, including a beverage container to receive a beverage threreinside, a lid to connect to a top portion of the beverage container, the lid including a rim disposed on an outer circumference of the lid, and a lid straw receiving aperture to receive a straw therethrough such that a user may drink the beverage stored in the beverage container through the straw, and a bowl to having a bottom portion thereof connected to a top portion the lid to receive food thereinside, the bowl including a bowl straw receiving aperture to correspond to the lid straw receiving aperture to allow the straw to be inserted simultaneously through the bowl straw receiving aperture and the lid straw receiving aperture.

The lid may further include a plurality of lid protrusions disposed around the rim to protrude orthogonally away from the rim.

The bowl may further include a plurality of protrusion receiving grooves to correspond to the plurality of lid protrusions to allow the bowl to lock onto the lid via the plurality of lid protrusions.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
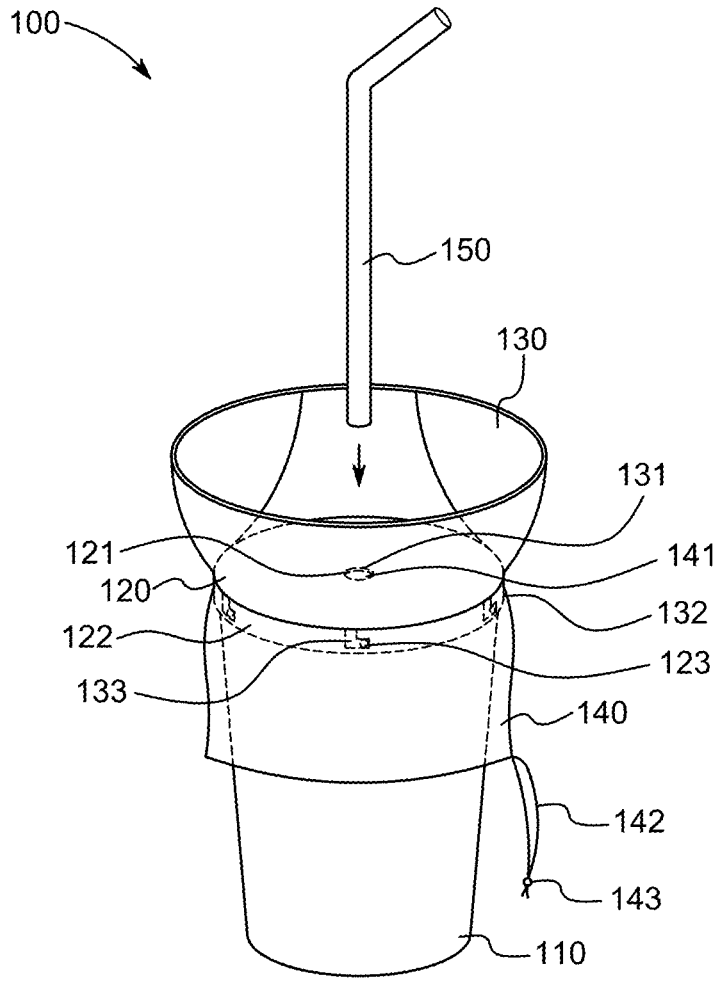
FIG. 1 illustrates a top perspective view of a combination beverage container and bowl including a bag in an open position, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Combination Beverage Container and Bowl 100
Beverage Container 110
Lid 120
Lid Straw Receiving Aperture 121
Lid Outer Rim 122
Lid Protrusions 123
Bowl 130
Bowl Straw Receiving Aperture 131
Bowl Base 132
Protrusion Receiving Grooves 133
Bag 140
Bag Straw Receiving Aperture 141
Draw String 142
Aglet 143
Straw 150

FIG. 1 illustrates a top perspective view of a combination beverage container and bowl 100 including a bag 140 in an open position, according to an exemplary embodiment of the present general inventive concept.

Figure 2:
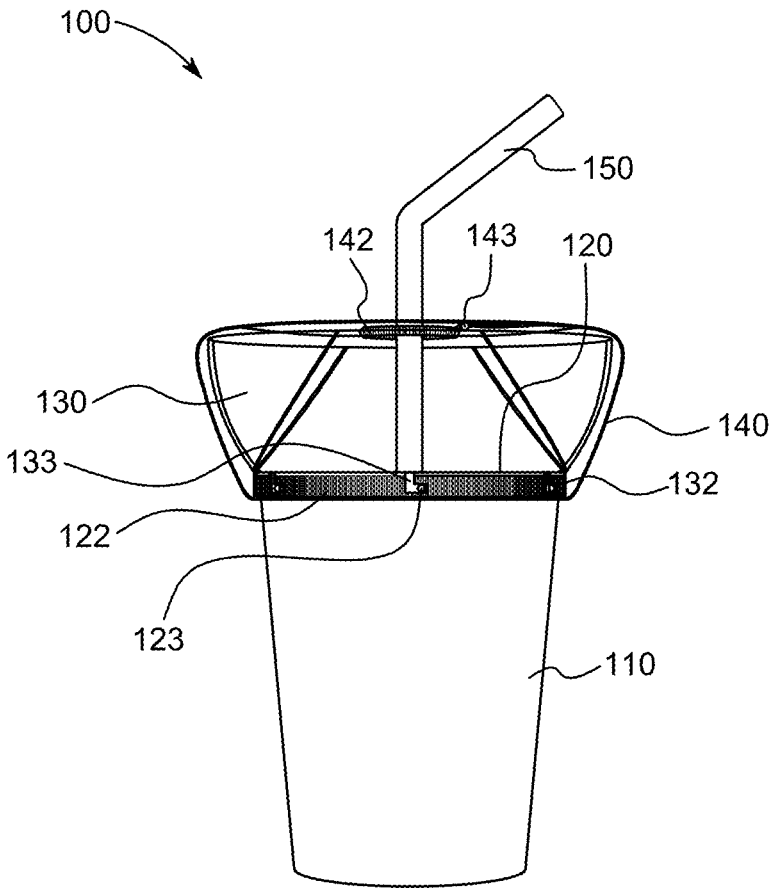
FIG. 2 illustrates a side perspective view of the combination beverage container and bowl of FIG. 1 including the bag in a closed position, according to an exemplary embodiment of the present general inventive concept.

FIG. 2 illustrates a side perspective view of the combination beverage container and bowl 100 of FIG. 1 including the bag 140 in a closed position, according to an exemplary embodiment of the present general inventive concept.

The combination beverage container and bowl 100, and all related components therein, may be constructed from at least one of metal, plastic, wood, paper, glass, and rubber, etc., but is not limited thereto.

Referring to FIG. 1, the combination beverage container and bowl 100 may include a beverage container 110, a lid 120, a bowl 130, a bag 140, and a straw 150, but is not limited thereto.

The beverage container 110 may be a container that is disposable or reusable, and may allow a user to store a beverage inside, such as soda, soft drinks, pop, punch, lemonade, ice tea, etc., but is not limited thereto, and may also allow a user to store anything thereinside, such as food.

The lid 120 may be designed to fit onto a top portion of the beverage container 110, and may be pressed onto the beverage container 110, screwed onto the beverage container 110, or inserted thereon in any manner known to one of ordinary skill in the art.

The lid 120 may include a lid straw receiving aperture 121, a lid rim 122, and a plurality of lid protrusions 123, but is not limited thereto.

The lid straw receiving aperture 121 may be disposed at a center portion of the lid 120, and may allow the straw 150 to be inserted therethrough to allow the user to drink a beverage disposed within the beverage container 110. When the straw 150 is inserted through the lid straw receiving aperture 121, the lid straw receiving aperture 121 may be entirely sealed, such that the beverage disposed within the beverage container 110 cannot exit the beverage container 110 unless it is sucked out through the straw 150.

The plurality of lid protrusions 123 may be disposed around a circumference of the lid 120, specifically along the lid rim 122, and may be provided singularly or in plurality. The plurality of lid protrusions 123 may protrude orthogonally away from the lid rim 122.

The bowl 130 may include a bowl straw receiving aperture 131, a bowl base 132, and a plurality of protrusion receiving grooves 133.

As illustrated in FIG. 1, the bowl 130 may be provided to be inserted onto a top portion of the lid 120.

The bowl base 132 may include the bowl straw receiving aperture 131 disposed at a center portion of the bowl base 132, although not limited thereto, in order to correspond to the lid straw receiving aperture 121, and may allow the straw 150 to be inserted therethrough and also through the lid straw receiving aperture 121 in order to allow the user to drink a beverage disposed within the beverage container 110. When the straw 150 is inserted through the bowl straw receiving aperture 131 and the lid straw receiving aperture 121, the bowl straw receiving aperture 131 and the lid straw receiving aperture 121 may be entirely sealed, such that the beverage disposed within the beverage container 110 cannot exit the beverage container 110 unless it is sucked out through the straw 150, and such that any objects (e.g., popcorn, candy, etc.) disposed within the bowl 130 cannot drop through the bowl straw receiving aperture 131 and the lid straw receiving aperture 121 into the beverage container 110.

Referring to FIG. 1, when the bowl 130 is placed onto the lid 120, the plurality of protrusion receiving grooves 133 may slide down onto the corresponding lid protrusions 123 to allow the user to lock the bowl 130 onto the lid 120 by turning the bowl 130 counter-clockwise (or clockwise, depending on a preference of a manufacturer and a direction in which the protrusion receiving grooves 133 are formed), such that the lid protrusions 123 cause the bowl 130 to be locked into place onto the lid 120.

In alternative embodiments, the lid 120 and the bowl 130 may be combined to form one object, such that the bowl 130 functions itself as the lid 120, and is not removable from the lid 120, but removable from the beverage container 110. Thus, in embodiments where the lid 120 and the bowl 130 are combined to form one object, the plurality of lid protrusions 123 may actually be may be disposed around a circumference of a top portion (e.g., a rim) of the beverage container 110, and the plurality of protrusion receiving grooves 133 may actually be disposed on side portion of the lid 120, specifically along the lid rim 122.

The bag 140 may include a bag straw receiving aperture 141, a draw string 142, and an aglet 143, but is not limited thereto.

The bag 140 may be provided to be disposed within the bowl 130, or may be disposed between the bowl 130 and the lid 120, such that the bag 140 is stably held and pinched between the bowl 130 and the lid 120.

The bag straw receiving aperture 141 may be disposed at a center portion of the bag 140, although not limited thereto, in order to correspond to the bowl straw receiving aperture 131 and the lid straw receiving aperture 121, and may allow the straw 150 to be inserted therethrough and also through the bowl straw receiving aperture 131 and the lid straw receiving aperture 121 in order to allow the user to drink a beverage disposed within the beverage container 110. When the straw 150 is inserted through the bag straw receiving aperture 141, the bowl straw receiving aperture 131, and the lid straw receiving aperture 121, the bag straw receiving aperture 141, the bowl straw receiving aperture 131, and the lid straw receiving aperture 121 may be entirely sealed, such that the beverage disposed within the beverage container 110 cannot exit the beverage container 110 unless it is sucked out through the straw 150, and such that any objects (e.g., popcorn, candy, etc.) disposed within the bowl 130 cannot drop through the bowl straw receiving aperture 131 and the lid straw receiving aperture 121 into the beverage container 110.

Referring to FIG. 2, the draw string 132 may be disposed around a circumference of the bag 140 to allow the user to tighten an opening of the bag 140 using the aglet 143. Thus, when the opening of the bag 140 is closed and the bag 140 stores popcorn thereinside, and within the bowl 130, the user can pop the popcorn in the bowl 130, and insert the bowl 130 onto the lid 120 after the popcorn is popped.

In exemplary embodiments of the present general inventive concept, the combination beverage container and bowl 100 offers a novelty accessory that combines beverage and popcorn containers, providing an easy and convenient primary carrying solution for consumers. Expanding on the initial design of an average soda cup, the combination beverage container and bowl 100 of the present general inventive concept introduces an option containing a detachable popcorn bowl 130, for example, that also may serve as the lid 120 of the beverage container 110. By attaching the bag 140 to the lid 120, the popcorn may be kept warm and fresh, ensuring customers are provided with delicious, high-quality popcorn every time. The draw string 142 may be stitched onto the bag to also allow for easy scrunching, ensuring that the popcorn is evenly distributed and users are able to enjoy their snack without any hassle. Additionally, the detachable popcorn bag 140 may be reusable and can be refilled multiple times, providing a sustainable and environmentally-conscious option for individuals as users manage quick refills and popcorn reheats, at their preference. This innovative, top-quality product may benefit all individuals and businesses looking to enhance their snack offerings, improve customer experience and/or offer the perfect solution for movie theaters, sports arenas, and any venue where snacks and beverages are commonly enjoyed. As a result, the combination beverage container and bowl 100 may prove to be essential in the food/beverage industry.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A combination beverage container and bowl, comprising:

a beverage container to receive a beverage threreinside;

a lid to connect to a top portion of the beverage container, the lid comprising:

a rim disposed on an outer circumference of the lid, and a lid straw receiving aperture to receive a straw therethrough such that a user may drink the beverage stored in the beverage container through the straw;

a bowl to having a bottom portion thereof connected to a top portion the lid to receive food thereinside, the bowl comprising:

a bowl straw receiving aperture to correspond to the lid straw receiving aperture to allow the straw to be inserted simultaneously through the bowl straw receiving aperture and the lid straw receiving aperture; and a bag having a portion disposed between the bowl and the lid, the bag comprising:

a draw string disposed around an outer circumference of the bag, and an aglet connected to ends of the draw string to allow the user to tighten an opening of the bag using the aglet, so that top opening of the bowl is at least partially sealed when the draw string is tightened.

2. The combination beverage container and bowl of claim 1, wherein the lid further comprises:

a plurality of lid protrusions disposed around the rim to protrude orthogonally away from the rim.

3. The combination beverage container and bowl of claim 2, wherein the bowl further comprises:

a plurality of protrusion receiving grooves to correspond to the plurality of lid protrusions to allow the bowl to lock onto the lid via the plurality of lid protrusions.

* * * * *